US007585437B2

(12) United States Patent
Jirsak et al.

(10) Patent No.: US 7,585,437 B2
(45) Date of Patent: Sep. 8, 2009

(54) METHOD OF NANOFIBRES PRODUCTION FROM A POLYMER SOLUTION USING ELECTROSTATIC SPINNING AND A DEVICE FOR CARRYING OUT THE METHOD

(75) Inventors: Oldrich Jirsak, Liberec (CZ); Filip Sanetrnik, Liberec (CZ); David Lukas, Liberec (CZ); Vaclav Kotek, Liberec (CZ); Lenka Martinova, Liberec (CZ); Jiri Chaloupek, Usti nad Labem (CZ)

(73) Assignee: Technicka Universita V Liberci, Liberec (CZ)

( * ) Notice: Subject to any disclaimer, the term of this patent is extended or adjusted under 35 U.S.C. 154(b) by 674 days.

(21) Appl. No.: 10/570,806

(22) PCT Filed: Sep. 8, 2004

(86) PCT No.: PCT/CZ2004/000056

§ 371 (c)(1),
(2), (4) Date: Mar. 6, 2006

(87) PCT Pub. No.: WO2005/024101

PCT Pub. Date: Mar. 17, 2005

(65) Prior Publication Data

US 2006/0290031 A1 Dec. 28, 2006

(30) Foreign Application Priority Data

Sep. 8, 2003 (CZ) ..... PV 2003-2421

(51) Int. Cl.
*B29B 9/00* (2006.01)

(52) U.S. Cl. ..... 264/6; 264/8; 264/10; 425/6; 425/8

(58) Field of Classification Search ..... None
See application file for complete search history.

(56) References Cited

U.S. PATENT DOCUMENTS

| | | | | |
|---|---|---|---|---|
| 4,069,026 | A | 1/1978 | Simm et al. | |
| 4,143,196 | A | 3/1979 | Simm et al. | |
| 6,382,526 | B1 | 5/2002 | Reneker et al. | |
| 6,520,425 | B1 | 2/2003 | Reneker | |
| 6,604,925 | B1 * | 8/2003 | Dubson | 425/6 |
| 2002/0084178 | A1 | 7/2002 | Dubson et al. | |
| 2002/0175449 | A1 | 11/2002 | Chu et al. | |
| 2003/0213218 | A1 | 11/2003 | Dubson | |

FOREIGN PATENT DOCUMENTS

| | | |
|---|---|---|
| EP | 1059106 | 12/2000 |
| GB | 1346231 | 2/1974 |
| WO | WO 0127365 | 4/2001 |
| WO | WO 0250346 | 6/2002 |
| WO | WO 03016601 | 2/2003 |

* cited by examiner

*Primary Examiner*—Mary Lynn F Theisen
(74) *Attorney, Agent, or Firm*—Dority & Manning, P.A.

(57) ABSTRACT

A method of nanofibers production from a polymer solution uses electrostatic spinning in an electric field created by a potential difference between a charged electrode and a counter electrode. The polymer solution for spinning is supplied into the electric field using the surface of a rotating charged electrode. On a part of the circumference of the charged electrode near to the counter electrode, a spinning surface is created for attaining a high spinning capacity. In a device for carrying out the method, the charged electrode is pivoted and part of its circumference is immersed in the polymer solution. The free part of the circumference of the charged electrode is positioned opposite the counter electrode.

24 Claims, 4 Drawing Sheets

Figure 1:
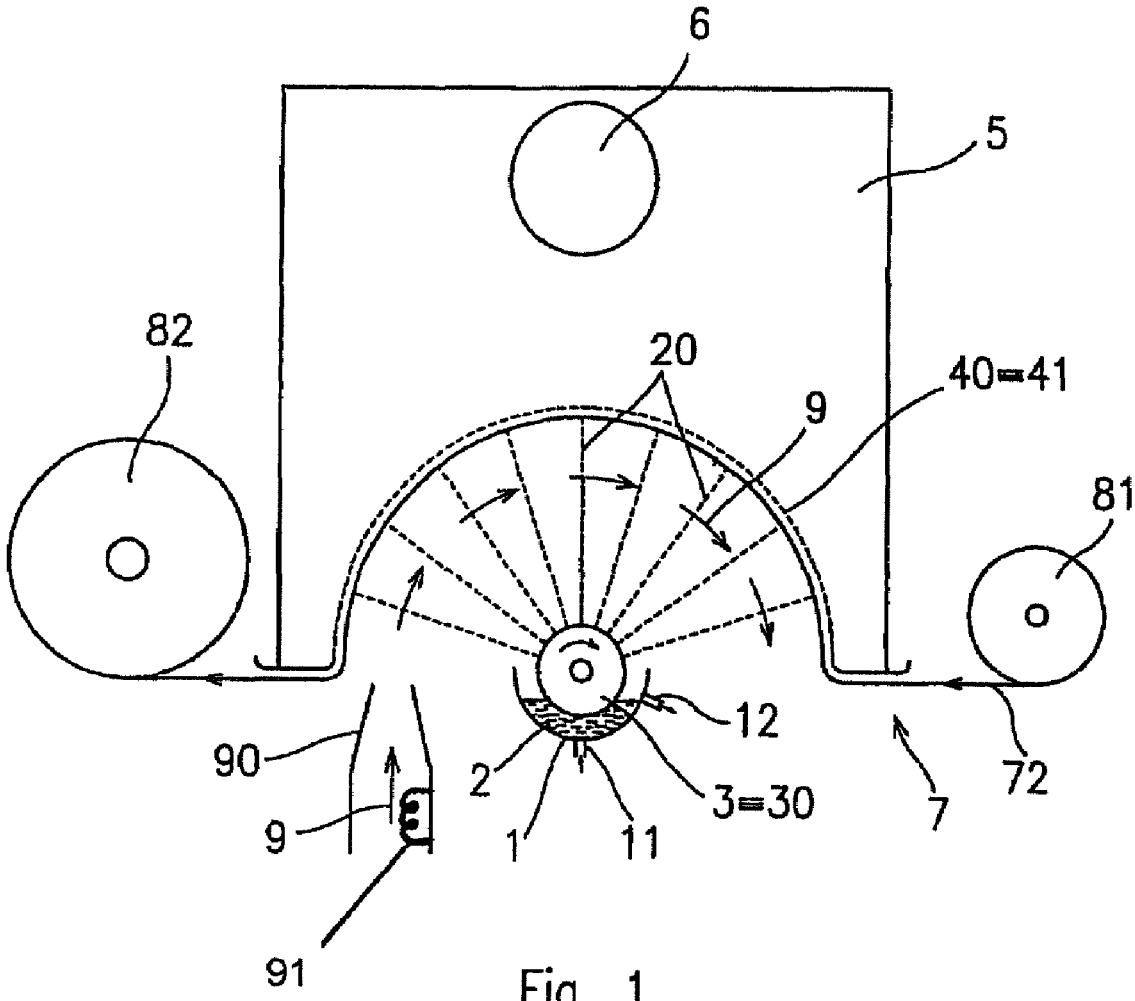

METHOD OF NANOFIBRES PRODUCTION FROM A POLYMER SOLUTION USING ELECTROSTATIC SPINNING AND A DEVICE FOR CARRYING OUT THE METHOD

CROSS-REFERENCE TO RELATED APPLICATIONS

This application claims priority to International Application Serial Number PCT/CZ04/00056 filed on Sep. 8, 2004, which claims priority to Czech Republic Application Serial No. PV 2003-2421 filed on Sep. 8, 2003.

TECHNICAL FIELD

The invention relates to a method of nanofibres production from a polymer solution using electrostatic spinning in an electric field created by a potential difference between a charged electrode and a counter electrode.

Further the invention relates to a device for carrying out the method and comprises a charged electrode and a counter electrode of a different potential, wherein between them an electric field is created.

BACKGROUND ART

Polymer fibres with diameters between 10 nm to 1,000 nm represent a new grade of materials with some very valuable properties. Such a typical field of use of polymer fibres layers is a filtration of gases and liquids, barrier materials for entrapment of submicron particles, bacteria and chemicals, where there is a very high filtering efficiency reached. Nanofibres are used as battery separators, composite reinforcement and as pharmaceutical carriers and tissue implant carriers in medicine. The high specific surface of the nanofibres makes them easily accessible to gaseous and liquid media, gives them their special sorptive properties and makes them suitable for their use as carriers of different active ingredients, e.g. catalysators. Extremely small pores in layers of nanofibres are a condition for extreme thermal insulating properties.

Nanofibres are made of a broad range of polymers, polymer blends and from blends of polymers with low molecular additives by forming processes involving polymer solutions. Unlike similar processes of forming fibres from polymer melts, forming fibres by processing polymer solutions can produce fibres with smaller diameters due to lower viscosities of the polymer solutions. For forming fibres from polymer solutions, mechanical forces of a flowing gaseous medium or coulombic forces in an electrostatic field can be used. Electrostatic spinning leads to fibres of lower diameters because a single fibre will split into a number of filaments owing to the distribution of equivalent charge in their volume.

Conventional methods and devices for production of nanofibres by polymer solutions forming by an air stream are described for example in U.S. Pat. No. 6,382,526 and U.S. Pat. No. 6,520,425. Polymer solutions are injected into a spinning jet of an annular section. The solutions are then formed by a mechanical action of an air stream delivered inside of the annulus, or as the case may be outside of this annulus, to produce fibres of diameters of 200 nm to 3,000 nm.

Forming of polymer solutions using an electrostatic field of mean intensity 50,000 V/m to 500,000 V/m is described in patent applications WO 0.127.365, WO 0.250.346, US 2002/0.175.449 A1 and US 2002/084.178 A1. According to these methods, the polymer solution is distributed into cylindrical spinning jets with inside diameters 0.5 mm to 1.5 mm. These jets are connected to a source of DC voltage. The electrostatic force attracts the effluent solvent to the counter electrode, which is usually grounded, and at the same time the effluent solvent is by this force formed into fine filaments, which are consequently split in a filament bundle of corresponding smaller diameter. Spinning is performed from one jet or an array of static or moving jets with the aim to increase the capacity of the device, even out the coverage of the counter electrode or the planar supporting material moving on a surface of the counter electrode or in the vicinity of its surface.

The drawback of all above mentioned methods and devices for production of nanofibres is that a very small amount of polymer material can be processed in a given time. In the case of nanofibres formed by mechanical forces, the diameter of the nanofibres so produced depends on, among other things, a ratio of air mass and polymer solution mass flowing through the spinning jet. While forming nanofibres by coulombic force in an electrostatic field, there must be formed a so called Taylor cone at the throat of the spinning jet, whose existence is a requirement for fibres formation, and the formation of the Taylor cone requires a relatively narrow range of the ratio of discharge velocity of the polymer solvent from the spinning jet to the intensity of the electrostatic field. The maximum adjustable intensity of the electrostatic field is limited by the dielectric strength of air, and above this limit discharges between electrodes happen. In consequence of the above mentioned circumstances and attainable concentrations of spinning polymer solutions, it is possible to process approximately 0.1 g to 1 g of polymer in an hour in one spinning jet, which from the industrial point of view makes the production of nanofibres very problematic.

The aim of the invention is to create a method and a device industrially applicable and able to reach a high spinning capacity.

OBJECTS AND SUMMARY OF THE INVENTION

The aim of the invention has been reached by a method of producing nanofibres wherein the polymer solution for spinning is delivered into the electrostatic field by a surface of a rotating charged electrode, while on a part of the circumference of the charged electrode near to a counter electrode a spinning surface is created. Under favorable conditions, the polymer solution is able to create Taylor cones in the electric field, not only while being discharged from a spinning jet but also on the surface of its level, and particularly advantageously in a thin layer on a surface of a rotating body partly immersed in a container with this polymer solution. By the mentioned favorable conditions is meant appropriate viscosity of the polymer solution given by the molecular weight of the polymer, its concentration and temperature, appropriate surface tension given by the type of polymer and the presence of a surface active ingredient and an appropriate value of the electric conductivity of the solution available by the presence of a low molecular electrolyte. The dimensions of the spinning surface are commensurate with the dimensions and the shape of the charged electrode and the counter electrode. The number of nanofibres being formed is commensurate with the dimensions and the shape of the spinning surface.

It is advantageous that the nanofibres produced from the polymer solution on the spinning surface of the charged electrode by the action of the electrostatic field tend to drift to the counter electrode under the influence of the electrostatic field, and they are laid down onto a means for nanofibres storage disposed in front of the counter electrode and form a layer on the means for nanofibres storage. This method enables the production of layers of nanofibres with a high quality and uniformity of the layer, which can be formed basically in arbitrary widths corresponding to the width of the device.

The action of the air stream together with the electric field promote drifting of the fibres out of the charged electrode.

However, it is advantageous if the nanofibres are drifting away towards the counter electrode and are stored on a means for nanofibres storage pervious to air in front of the counter electrode and form a layer on the means for nonofibres storage.

An air stream moving in the direction toward the counter electrode is created by sucking the air. Using this simple method, the drifting of fibres towards the counter electrode is promoted and the productivity is increased.

The nanofibres in the space between the charged electrode and the counter electrode can be deflected by the air stream from their course towards the counter electrode and they are led to the means for nanofibres storage pervious to air, which is situated outside of the electrical field that causes the spinning of the polymer solution.

The air stream for deflecting the nanofibres from their course from the charged electrode towards the counter electrode is advantageously produced by sucking of the air from the space between the electrodes into the space behind the means for nanofibres storage pervious to air in regard of the charged electrode.

For increased productivity of the device it is advantageous if into the space between the electrodes where the nanofibres produced by electrostatic spinning are drifting away, auxiliary drying air is supplied to accelerate the evaporation of the polymer solvent from the nanofibres.

To increase the drying efficiency by acceleration of the evaporation of the polymer solvent, it is advantageous, when at least a part of auxiliary drying air is drawn out of the space in front of the supporting device pervious to air in regard of the charged electrode, without passing through this supporting device.

In accordance with an aspect of the present invention, an increase in productivity can be obtained by heating up the delivered auxiliary drying air to enable the heated drying air to draw away a bigger amount of the solvent vapours that are created during the drying of the nanofibres.

For all embodiments of the method it is advantageous to use an aqueous polymer solution because the overall construction of the device is easier and there is no need for removal of harmful or dangerous gases from the polymer solvent.

In accordance with the present invention, the charged electrode is pivoted so that a part of its circumference is immersed in the polymer solution while the free part of the circumference of the charged electrode is positioned opposite the counter electrode. Such an arranged device is able to deliver a sufficient amount of the polymer solvent into the electric field.

In accordance with an embodiment of the present invention, the counter electrode surrounds the free parts of the circumference of the charged electrode along its entire length, while in the entire space between the electrodes an electric field of the same intensity is created.

The nanofibres are laid down in layers on the surface of the means for nanofibres storage situated between both electrodes.

There is an advantageous embodiment of the device in which the means for nanofibres storage is pervious to air and there is an air stream passing through this device.

In alternative embodiment, a vacuum is produced forming an air stream that pulls the nanofibres away from the space between the electrodes and towards the means for nanofibres storage through which passes at least a part of the air, and the means for nanofibres storage is disposed outside of the space between the electrodes. In any of the foregoing embodiments of the device, it is advantageous to form a means for nanofibres storage.

For increased evaporation of the solvent from nanofibres, auxiliary drying air is supplied into the device for producing nanofibres.

Advantageous embodiments of the charged electrode are intended to reach the best possible spinning efficiency of the device in which they are going to be used.

BRIEF DESCRIPTIONS OF THE DRAWINGS

Figure 2:
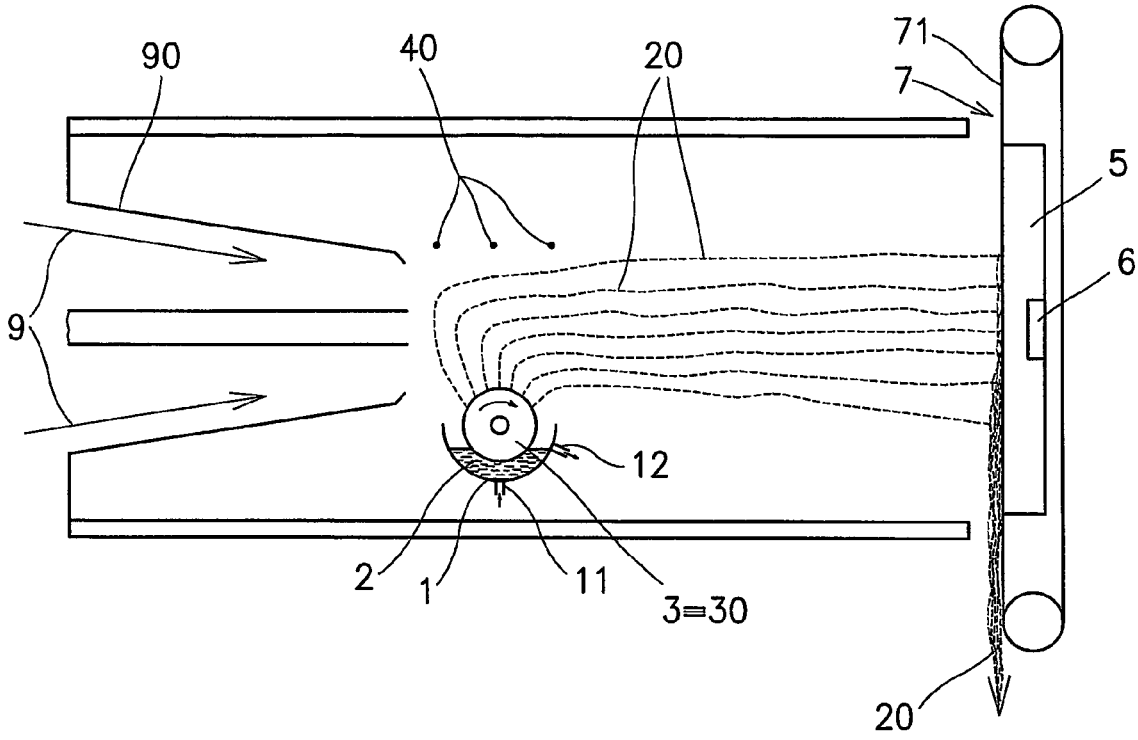
Figure 3:
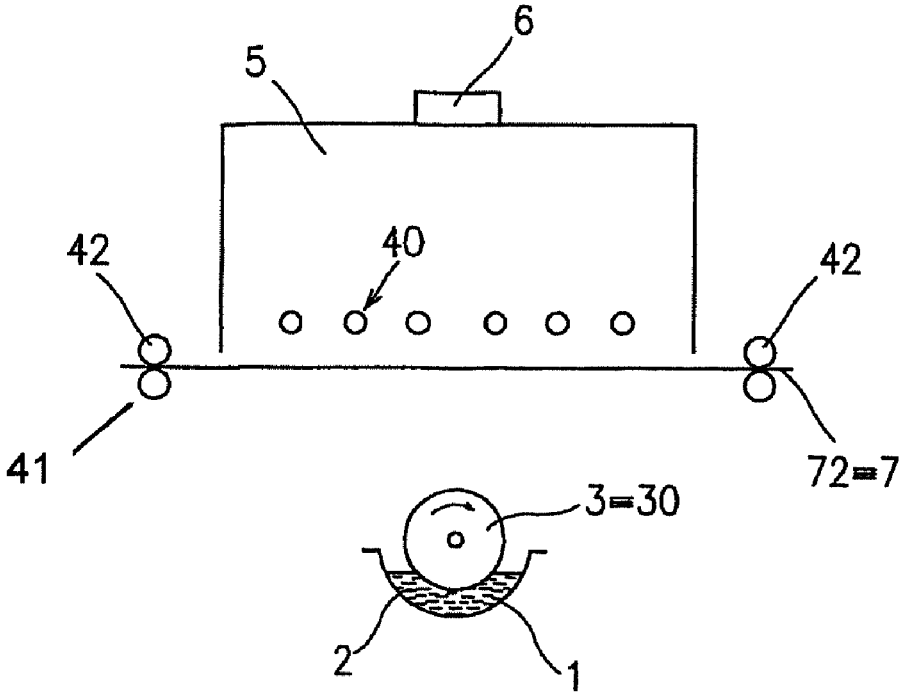
Figure 4:
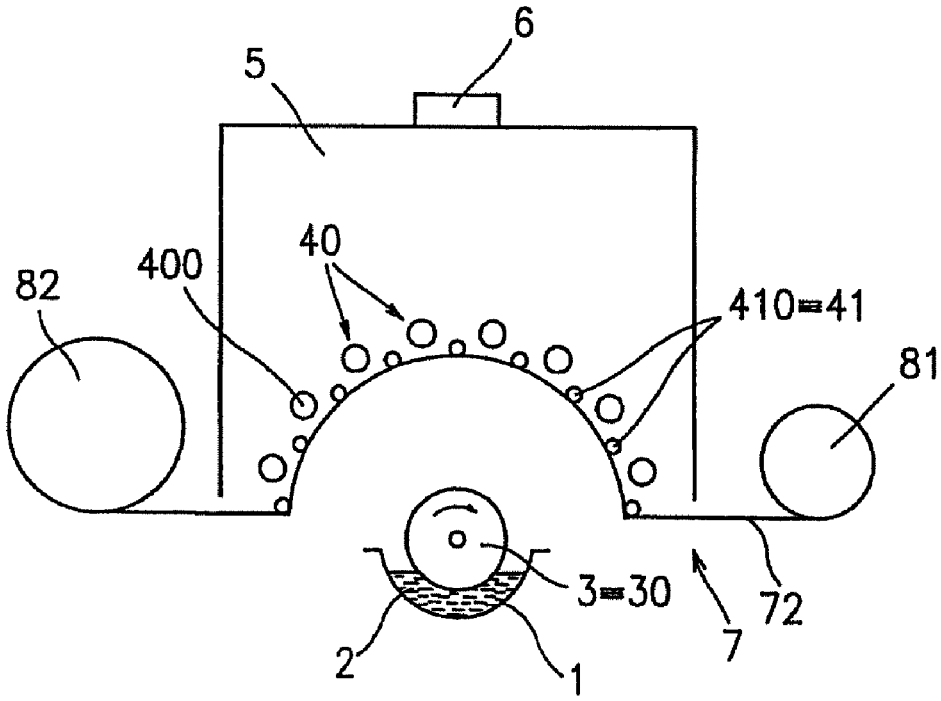
Figure 5A:
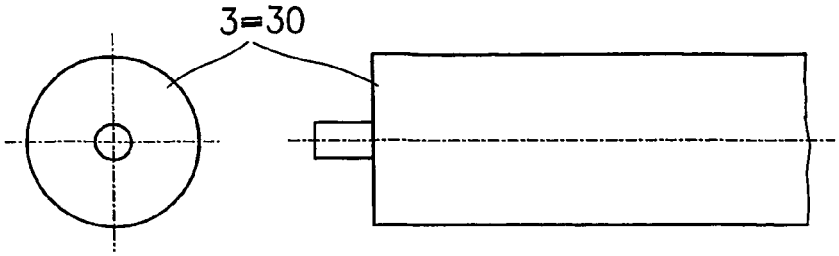
Figure 5B:
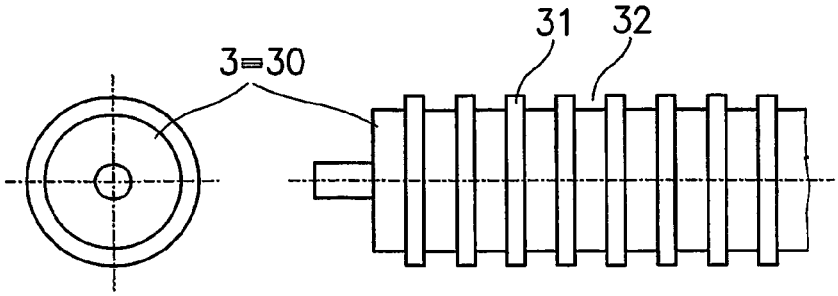
Figure 5C:
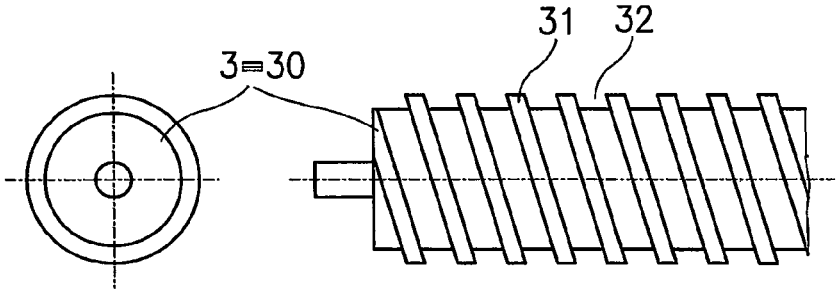
Figure 5D:
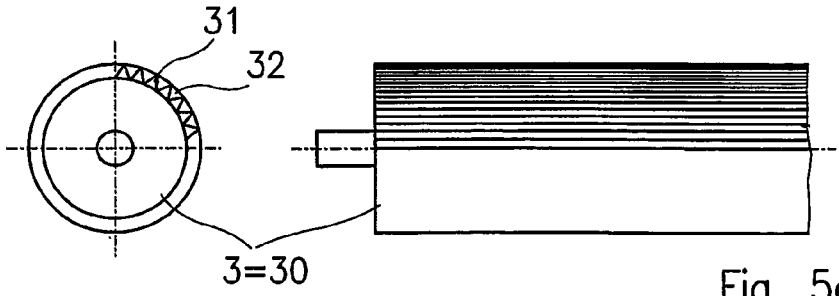
Figure 5E:
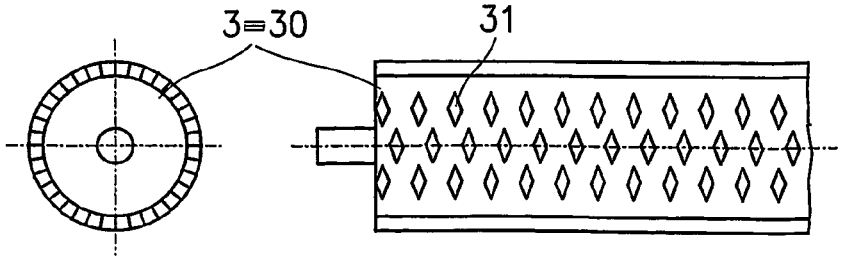

Examples of a device embodiment according to the invention are schematically shown in the enclosed drawings where:

FIG. 1 is a cross section of a device with a counter electrode surrounding a part of the circumference of a charged electrode, FIG. 2 is a cross section of an embodiment of the device with a means for nanofibres storage outside of the space between the electrodes, FIG. 3 is a cross section of the device, where the means for nanofibres storage is formed by a plane supporting material positioned between the electrodes in the conveyance composed of stretching elements, FIG. 4 is an embodiment similar to that shown in FIG. 1 but with a fixed electrode composed of longitudinal rods and the conveyance of the planar supporting material of nanofibres arranged between these rods, FIGS. 5*a* to 5*e* are views of various embodiments of the surface of a cylinder representing a charged electrode from the front and from the side.

DETAILED DESCRIPTION OF EXEMPLARY EMBODIMENTS

As shown in FIG. 1, a device for producing nanofibres from a polymer solution using electrostatic spinning in an electric field created by a potential difference between a charged electrode and a counter electrode includes a container 1 at least partly filled with a polymer solution 2. A pivoted cylinder 3 has a part of its circumference immersed in the polymer solution in the container 1 and is by a well-known method (not shown) connected to a source of DC voltage and thereby forms a charged electrode 30. Opposite a free part of the circumference of the charged electrode 30 is disposed a counter electrode 40 with a different electric potential than the charged electrode 30. The counter electrode 40 is usually connected to earth (grounded), as described in FIG. 1, or it is by a well-known method (not shown) connected to a source of DC voltage of a different polarity.

In the embodiments shown, the bottom part of the circumference of the cylinder 3 is the part of the cylinder 3 that is immersed in the polymer solution 2. However, such an arrangement can be changed according to an example (not shown) in which polymer solution 2 is drawn from a closed container and is applied on a different surface of the charged electrode 30. Alternatively, the cylinder 3 presenting the charged electrode 30 is in such closed container positioned, while the polymer solution 2 is wetting for example the top part of the circumference of the cylinder 3, which draws on its circumference an appropriate amount of the polymer solution 2 from the container.

In the example of the embodiment shown in FIG. 1, the counter electrode 40 is made of a perforated conducting material, e.g. sheet metal, shaped in a cylindrical surface, which forms the front end of a vacuum chamber 5, which is connected to a vacuum source 6. A part of the surface of the counter electrode 40 near the charged electrode 30 serves as a conveyance 41 for planar supporting material 72 pervious to air, which is for example made of a backing fabric and which is positioned on an unreeling device 81 arranged on one side of the vacuum chamber 5 and on the reeling device 82, which is arranged on the other side of the vacuum chamber 5. In this represented embodiment the planar supporting material 72 for the nanofibres forms in itself a means 7 for nanofibres storage pervious to air.

The container 1 for the polymer solution 2 is open and fitted with at least one polymer solution inlet 11 and at least one polymer solution outlet 12. The mentioned polymer solution inlet 11 and outlet 12 serve to provide circulation of the polymer solution 2 and to maintain the constant height of its level in the container 1.

A supply 90 is provided to supply auxiliary drying air 9 to the space between the charged electrode 30 and the counter electrode 40. The auxiliary drying air 9 can be (according to any well-known manner) heated up as needed, for example by using a heating device 91 arranged in the auxiliary drying air supply 90. The auxiliary drying air 9 is either completely or partly sucked from the space between the charged electrode 30 and the counter electrode 40 and into the vacuum chamber 5 or it comes out on the other side from the side from which it is supplied.

By rotating the charged electrode 30, the part of its circumference that is immersed in the polymer solution 2 draws the polymer solution 2 from the container 1 into the space between the charged electrode 30 and the counter electrode 40, where an electric field is formed. On the surface of the charged electrode 30, Taylor cones of a high stability are formed from the polymer solution 2 and present places of primary formation of the nanofibres 20. The formed nonofibres 20 are by the effects of the electric field attracted to the counter electrode 40 and consequently they are deposited on the surface of the backing fabric presenting the planar supporting material 72. The deposited nanofibres are formed into a layer on the planar supporting material 72, and the thickness of the layer of nanofibres is controlled using the velocity of the unreeling device 81 and the reeling device 82.

The drifting of the nanofibres 20 away from the charged electrode 30 to the counter electrode 40 is promoted by streaming of air sucked from the outer space into the vacuum chamber 5 and passing along the polymer solution container 1 and the charged electrode 30 and passing through the backing fabric presenting the planar supporting material 72 to the nanofibres and through the counter electrode 40.

In the embodiment shown in FIG. 4, the counter electrode 40 is manufactured using another appropriate method, for example from rods 400 parallel to the pivoted cylinder 3 presenting the charged electrode 30. Between the rods 400 forming the counter electrode 40 there are arranged auxiliary rods 410 forming a conveyance 41 for the planar supporting material 72 for the nanofibres that forms the means 7 for nanofibres storage. Nevertheless, some or all of the auxiliary rods 410 can be rotable to lower the friction drag while conveying the supporting material 72 for the nanofibres. The conveyance for the supporting material 72 for the nanofibres can be in this embodiment composed also of rods 400 forming the counter electrode 40. In the described device, the nanofibres 20 are produced in such high numbers that the limiting factor of the spinning device capacity is the evaporation rate of the polymer solvent from the produced nanofibres 20 and the rate of drawing off of the evaporated solvent, which would in a short period create a saturated vapour state, which would not permit any further solvent evaporation in the space between the charged electrode 30 and the counter electrode 40. The device is therefore fitted with the auxiliary drying air supply 90, which provides drawing off of the solvent vapours especially from the space between the charged electrode 30 and the counter electrode 40. To increase its effectiveness, this auxiliary drying air 9 can be heated up.

The next example according to the invention is described in FIG. 2, where similar to the embodiment according to FIG. 1, the charged electrode 30 is pivoted so that part of its circumference is positioned in the polymer solution 2, which is in the container 1. The circulation of the polymer solution 2 and its level in the container 1 is maintained by flowing of the polymer solution 2 through the inlet 11 and the outlet 12. Opposite the free part of the circumference of the pivoted charged electrode 30, the counter electrode 40 is positioned. The counter electrode 40 is composed of a system of wires or rods connected to earth (grounded) or by a well-known manner (not shown) connected to a source of DC voltage of opposite polarity than the charged electrode 30. Outside of the space between the electrodes (30, 40), where the electrostatic field is created and where by electrostatic spinning the nanofibres 20 from the polymer solution 2 are produced, there is positioned a conveyor 71 of nanofibres pervious to air. The conveyor 71 forms the device 7 for nanofibres storage. The vacuum chamber 5 is disposed behind the conveyor and is connected to the vacuum source 6.

The nanofibres 20 directed from the charged electrode 30 to the counter electrode 40 due to the action of the electric field are by the action of an air stream sucked toward the vacuum chamber 5. The nanofibres 20 are deflected from their course and onto the conveyor 71 pervious to air. The nanofibres 20 on the surface of the conveyor 71 are stored in a layer, which is by the motion of the conveyor 71 carried out of the device and thereafter in some appropriate manner (not shown) processed, conditioned or stored. To increase the amount of air in the space between the electrodes 30, 40, the device is fitted with the inlet 90 of auxiliary drying air 9, which enters the device casing in the direction toward the conveyor 71 pervious to air. The auxiliary drying air 9 further promotes deflecting the nanofibres 20 from the course toward the counter electrode 40 and onto the direction toward the conveyor 71 pervious to air.

Also in this embodiment there is a possibility of various modifications in the arrangement and shape of the counter electrodes. There is also the possibility to insert in front of the conveyor 71 pervious to air, a backing fabric or another planar supporting material 72, and the layer of the nanofibres 20 can be stored onto this planar supporting material 72.

FIG. 3 describes an embodiment of the device comprising a pivoted charged electrode 30 having the bottom part of its circumference immersed into the polymer solution 2. Opposite the free part of the circumference of the pivoted charged electrode 30, there is positioned the counter electrode 40 composed of a system of rods parallel to the axis of rotation of the charged electrode 30. Using conveyance 41 composed of stretching elements 42, the planar supporting material 72 for the nanofibres is conveyed through the space between the electrodes 30, 40.

The charged electrode 30 comprises a body able to rotate, for example a cylinder, quadrangular or multiangular prism and the like, and it also is advantageous if the axis of rotation is the same as the axis of symmetry of the body. The circumference of the cylinder 3 is fitted with lugs 31 and/or recesses 32. Examples of shapes of the cylinder surface appropriate for the charged electrode are described in FIGS. 5*a* to 5*e*. However, these shapes do not limit all possible embodiments but serve only as examples. In embodiments that have been described above, there is created a steady electric field between the electrodes. The device nonetheless can be fit with means for creating an intermittent electric field if it is necessary for creating or storage of the nanofibres 20 layer.

Specific examples are described below.

Example of Embodiment 1

The polymer solution container 1 of the device according to FIG. 1 is being filled with 12% aqueous polyvinyl alcohol solution with 88% degree of hydrolysis of a molecular weight M.sub.w=85,000, containing 5 mole percent citric acid as a crosslinking agent referred to structural units of the polymer. The viscosity of the solution is 230 mPas at 20 degrees C., the specific electric conductivity is 31 mS/cm and the surface tension is 38 mN/m. The polymer solution 2 flows into the container 1 through an inlet 11 and flows off through an outlet 12 while the level height of the polymer solution 2 in the container 1 is maintained using the position of the outlet 12. The charged electrode 30 consists of a cylinder 3 of 30 mm in diameter as in the embodiment according to FIG. 5*c*, and it is rotating clockwise at 2.5 RPM. The cylinder 3 is connected to a +40 kV DC voltage source. The device is manufactured according to FIG. 1, and a backing fabric forming a planar supporting material 72 for the nanofibres passes through the device. Owing to the low pressure in the low pressure chamber 6 behind the counter electrode 40 pervious to air, the planar material follows the path of the counter electrode 40, which forms in this way the planar material conveyance. The surface of the rotating cylinder 3 draws the polymer solution 2 out of the container 1 and owing to the electric field between the electrodes 30, 40, the polymer solution 2 forms Taylor cones and nanofibres 20 in diameters 50 to 200 nanometers. The nanofibres 20 migrate to the counter electrode 40, and they are stored on the running backing fabric, where they form a layer of thickness that can be controlled by the movement speed of the backing fabric. Into the space between the electrodes, auxiliary drying air 9 at a temperature of 50 degrees C. is supplied. The layer of nanofibres is produced at the rate of 1.5 g/min per one meter length of rotating cylinder 3.

Example of Embodiment 2

The polymer solution container 1 of the device according to FIG. 2 is being filled with 10% aqueous polyvinyl alcohol solution with 98% degree of hydrolysis of a molecular weight M.sub.w=120,000, containing 5 mole percent citric acid as a crosslinking agent referred to structural units of the polymer. The viscosity of the solution is 260 mPas at 20 degrees C., its specific electric conductivity has been adjusted by an addition of a small amount of aqueous NaCl solution to 25 mS/cm, and the surface tension has been adjusted by the addition of 0.25% nonionogene surface active agent to 36 mN/m. The polymer solution 2 flows into the container 1 through an inlet 11 and flows off through an outlet 12, and the position of the outlet 12 determines the level height of the polymer solution 2 in the container 1. The cylinder 3 forming the charged electrode is 50 mm in diameter and has a smooth surface as described in FIG. 5*a*. The cylinder 3 is connected to a +40 kV DC voltage source, and the wire counter electrode 40 is connected to a negative 5 kV DC voltage source. In the space between the charged electrode 30 and the counter electrode 40, nanofibres 20 are produced in a diameter of 50 to 200 nanometers. Along with the air sucked from the space between the electrodes 30, 40 into the vacuum chamber 5, the nanofibres 20 are pulled away from the electrode 30 and use the auxiliary drying air 9 to migrate to the surface of the conveyor 71 pervious to air, where they are stored in a fibre layer at the rate of 1.8 g/min per one meter length of rotating cylinder.

INDUSTRIAL APPLICABILITY

A method and a device according to the invention are applicable for production of layers of nanofibres in diameters from 50 to 200 nanometers. These layers can be used for filtration, as battery separators, for production of special composites, for construction of sensors with extremely low time constants, for production of protective clothes, in medicine and other fields.

The invention claimed is:

1. A high capacity spinning method of producing nanofibres from a conductive polymer solution using electrostatic spinning in an electric field created by a potential difference in the space between a charged electrode and a counter electrode, the method comprising:

providing a device for nanofibres storage, the device having a planar surface moving in a first direction;

rotating the charged electrode having a body elongated in a direction of the rotational axis of the charged electrode, which rotational axis is perpendicular to the movement direction of the planar surface of the device for nanofibres storage and is parallel to the plane of this device for nanofibres storage;

using a part of the circumference of the charged electrode near to the counter electrode as a spinning surface from which the nanofibres are formed from the conductive polymer solution by the action of the electric field;

drifting the formed nanofibres toward the counter electrode;

wherein an air stream acts on nanofibres moving in the space between the charged electrode and the counter electrode, which air stream is directed to promote drifting of the nanofibres away from the charged electrode; and collecting nanofibres in a layer on the planar surface of the device for nanofibres storage.

2. A method as in claim 1, wherein the spinning surface of the charged electrode is a cylinder.

3. A method as in claim 1, wherein the nanofibres are by an air stream drift away towards the counter electrode before which they lay down onto the device for nanofibres storage and form a layer on it.

4. A method as in claim 1, wherein the air stream is produced by sucking the air from the space between the electrodes into the space behind the counter electrode.

5. A method as in claim 1, wherein the nanofibres are by the air stream deflected from their course towards the counter electrode and are led to the device for nanofibres storage pervious to air, onto which surface they are stored in a layer in a space out of reach of the electric field between the electrodes where they were produced.

6. A method as in claim 5, wherein the air stream is produced by sucking of the air from the space between the electrodes into the space behind the device for nanofibres storage pervious to air.

7. A method as in claim 1, wherein auxiliary drying air is supplied into the space between the charged electrode and the counter electrode.

8. A method as in claim 7, wherein at least a part of the auxiliary drying air is drawn off the space in front of the device for nanofibres storage pervious to air without passing through the device for nanofibres storage.

9. A method as in claim 1, wherein auxiliary drying air is heated before being supplied into the space between the charged electrode and the counter electrode.

10. An electrostatic spinning device for nanofibres production from a polymer solution, comprising:

a container for the polymer solution;

a rotatable charged electrode that is rotatable about a rotational axis, said charged electrode having a body that is elongated in the direction of said rotational axis, said charged electrode being disposed so that during rotation of the charged electrode a first portion of said charged electrode is disposed in said container while a second portion of said charged electrode is disposed out of said container;

a counter electrode disposed opposite said second portion of said charged electrode so as to create therebetween an electric field created by a potential difference between the second portion of said charged electrode and the counter electrode;

a device for nanofibres storage, said device for nanofibres storage being movable in a direction that is perpendicular to the direction of the axis of rotation of said charged electrode; and a vacuum source disposed in the space behind the device for nanofibres storage in regard to the charged electrode and serving to create an air stream directing out of the space between the electrodes and towards the device for nanofibres storage, and wherein the device for nanofibres storage is pervious to air.

11. A device as in claim 10, wherein the charged electrode is a cylinder.

12. A device as in claim 11, wherein lugs and/or recesses are defined on the surface of the cylinder of the charged electrode.

13. A device as in claim 10, wherein the charged electrode is a prism.

14. A device as in claim 10, wherein the counter electrode is configured to surround the entire length of the second portion of the charged electrode.

15. A device as in claim 10, wherein said device for nanofibres storage is pervious to air and disposed between said second portion of said charged electrode and said counter electrode.

16. A device as in claim 10, further comprising:

a vacuum source disposed in the space behind the device for nanofibres storage in regard to the charged electrode and serving to create an air stream directing out of the space between the electrodes and towards the device for nanofibres storage; and wherein said device for nanofibres storage is pervious to air and disposed outside of the space between the electrodes.

17. A device as in claim 10, wherein the device for nanofibres storage is composed of a conveyor pervious to air.

18. A device as in claim 10, wherein the device for nanofibres storage is composed of a plane supporting material of the nanofibres.

19. A device as in claim 18, wherein the plane supporting material is positioned on a conveyance.

20. A device as in claim 19, wherein the conveyance is composed of a counter electrode.

21. A device as in claim 19, wherein the conveyance is composed of stretching elements of plane supporting material of the nanofibres.

22. A device as in claim 10, further comprising:

an air inlet configured and disposed to direct auxiliary drying air into the space between the electrodes.

23. A device as in claim 22, further comprising:

an air heating device positioned in the air inlet for auxiliary drying air.

24. A device as in claim 22, wherein said air inlet is configured and disposed to direct auxiliary drying air into the space between the electrodes such that at least a part of the drying air is drawn off the space in front of the device for nanofibres storage in regard of the charged electrode, without passing through the device for nanofibres storage.

* * * * *